US009038243B2

(12) United States Patent
Haar et al.

(10) Patent No.: US 9,038,243 B2
(45) Date of Patent: May 26, 2015

(54) DOOR ESCAPE

(71) Applicant: CNH AMERICA LLC, New Holland, PA (US)

(72) Inventors: William Ryan Haar, Wichita, KS (US); Lance A. Taylor, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 13/746,814

(22) Filed: Jan. 22, 2013

(65) Prior Publication Data

US 2013/0192026 A1 Aug. 1, 2013

Related U.S. Application Data

(60) Provisional application No. 61/591,471, filed on Jan. 27, 2012.

(51) Int. Cl.
*E05D 7/10* (2006.01)
*E05D 7/12* (2006.01)

(52) U.S. Cl.
CPC ..... *E05D 7/121* (2013.01); *Y10T 16/535* (2015.01); *E05Y 2600/61* (2013.01); *E05Y 2600/626* (2013.01); *E05Y 2900/132* (2013.01)

(58) Field of Classification Search
CPC ..... E05D 7/121; E05Y 2600/61; E05Y 2600/626
USPC ..... 16/264, 382–384, 254, 261, 387; 296/190.11, 146.11, 146.2; 292/202, 292/146.11; 49/62, 141, 463, 465
See application file for complete search history.

(56) References Cited

U.S. PATENT DOCUMENTS

| | | | | |
|---|---|---|---|---|
| 546,909 | A | 9/1895 | Spencer | |
| 1,863,323 | A * | 6/1932 | Berne | 16/256 |
| 2,609,069 | A * | 9/1952 | McLaughlin | 52/796.1 |
| 3,869,753 | A * | 3/1975 | Boback | 16/382 |
| 3,967,859 | A | 7/1976 | Whisler | |
| 3,978,550 | A | 9/1976 | Brown | |
| 4,226,052 | A * | 10/1980 | DeStepheno | 49/465 |
| 4,720,895 | A * | 1/1988 | Peebles | 16/264 |
| 4,908,908 | A * | 3/1990 | Mitsuoka et al. | 16/251 |
| 5,029,364 | A * | 7/1991 | Salazar | 16/382 |
| 5,462,320 | A | 10/1995 | Davis | |
| 5,504,974 | A | 4/1996 | Graber | |
| 6,247,746 | B1 | 6/2001 | Brush | |
| 6,698,821 | B2 * | 3/2004 | Racz | 296/202 |
| 6,811,209 | B2 * | 11/2004 | Woollett et al. | 296/190.11 |
| 7,614,117 | B2 | 11/2009 | Selvaraj | |
| 7,758,104 | B2 | 7/2010 | Liebl et al. | |
| 7,938,479 | B2 * | 5/2011 | Tuhy | 296/190.11 |
| 8,029,044 | B2 | 10/2011 | Akahane et al. | |
| 2003/0067188 | A1 | 4/2003 | Go | |
| 2007/0245522 | A1 * | 10/2007 | Selvaraj | 16/258 |
| 2010/0264696 | A1 | 10/2010 | Tuhy | |
| 2012/0047687 | A1 * | 3/2012 | Halbritter | 16/382 |

* cited by examiner

*Primary Examiner* — Victor Batson
*Assistant Examiner* — Matthew Sullivan
(74) *Attorney, Agent, or Firm* — Sue C. Watson

(57) ABSTRACT

A door escape includes a hinge member securable to a door pivotably movable between an open position and a closed position relative to an enclosure. A first securing device secures the hinge member to the door. The first securing device is manually removable from the hinge member from exterior of the enclosure, permitting removal of the door from the enclosure. A second securing device secures the hinge member to the door. The second securing device is manually removable from the hinge member from interior of the enclosure, permitting removal of the door from the enclosure.

21 Claims, 4 Drawing Sheets

DOOR ESCAPE

BACKGROUND OF THE INVENTION

Work vehicles, such as skid steer loaders or compact track loaders, include a cab structure to protect the operator. The cab structures fully enclosure the operator and include an elongated door that is pivotably connected to the cab structure. During operation, it may be possible for the lifting structure associated with the work vehicle that manipulates an attachment such as a bucket, to stall in a position that prevents the door from pivoting sufficiently with respect to the cab structure, thereby trapping an operator inside of the cab structure. Moreover, in case the operator is incapacitated or otherwise unable to operate egress equipment accessible only from interior of the cab structure, extreme measures, such as removing the attachment from the work vehicle, which may not be possible, or otherwise damaging the cab structure to extricate the operator may be required.

Accordingly, it would be desirable for a door assembly having features permitting easy manual removal of the door assembly from exterior (as well as interior) of the work vehicle.

SUMMARY OF THE INVENTION

In accordance with one aspect of the present invention, a door escape includes a hinge member securable to a door pivotably movable between an open position and a closed position relative to an enclosure. A first securing device secures the hinge member to the door. The first securing device is manually removable from the hinge member from exterior of the enclosure, permitting removal of the door from the enclosure. A second securing device secures the hinge member to the door. The second securing device is manually removable from the hinge member from interior of the enclosure, permitting removal of the door from the enclosure.

In accordance with one aspect of the present invention, a door escape includes a hinge member securable to a door pivotably movable between an open position and a closed position relative to an enclosure. A first securing device secures the hinge member to the door. The first securing device is manually removable from the hinge member from exterior of the enclosure, permitting removal of the door from the enclosure. A second securing device secures the hinge member to the door. The second securing device is manually removable from the hinge member from interior of the enclosure, permitting removal of the door from the enclosure. Mating support features are formed in corresponding portions of the hinge member and the door.

In accordance with one aspect of the present invention, a method for removing a door from an enclosure including providing a hinge member secured to a door pivotably movable between an open position and a closed position relative to the enclosure. The method further includes providing a first securing device for securing the hinge member to the door, the first securing device being manually removable from the hinge member from exterior of the enclosure. The method further includes providing a second securing device for securing the hinge member to the door, the second securing device being manually removable from the hinge member from interior of the enclosure. The method further includes manually removing the first securing device or the second securing device.

An advantage of the door escape of the present invention is an ability to manually access and remove a door from either a position interior or exterior of an enclosure (i.e., from either side of the door).

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
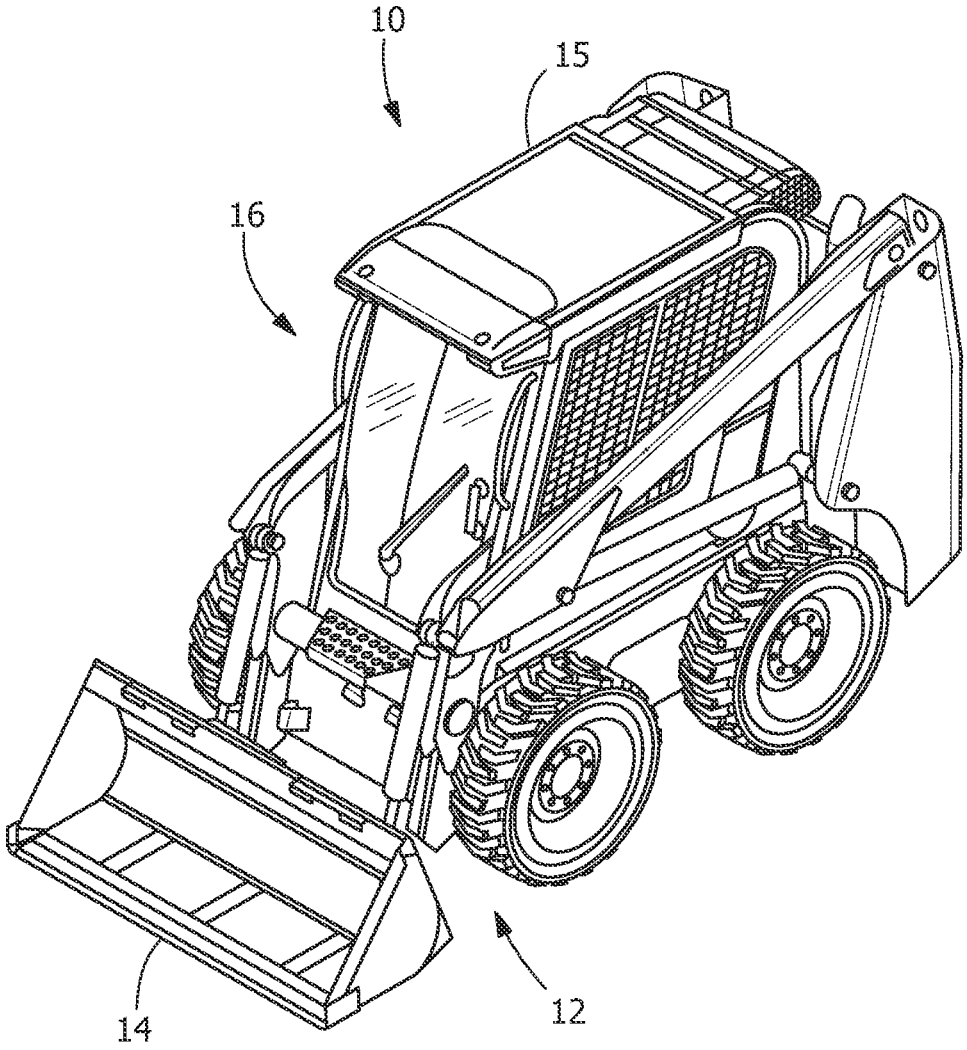
FIG. 1 is an upper perspective view of an embodiment of a work machine.
Figure 2B:
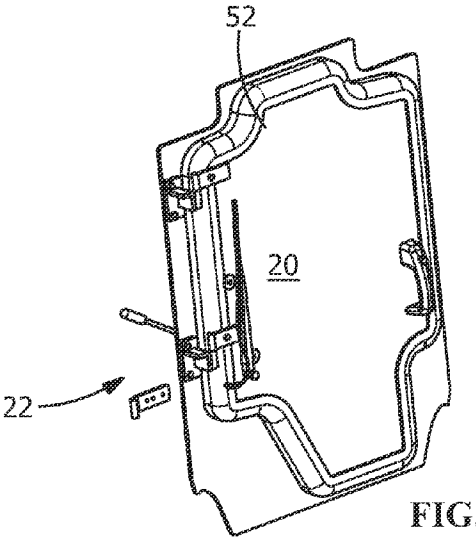
FIGS. 2A and 2B are respective front and upper perspective views of an exterior surface of a door assembly of the work machine.
Figure 2A:
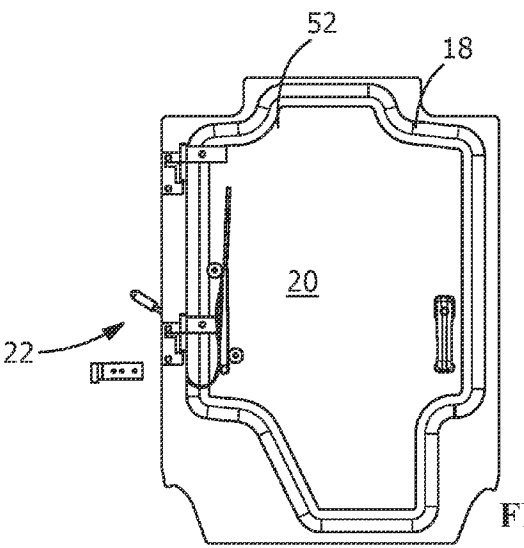
Figure 3B:
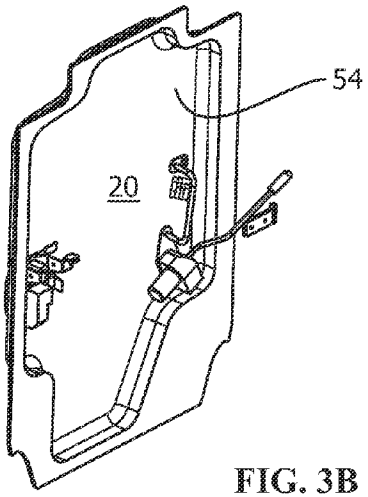
FIGS. 3A and 3B are respective front and upper perspective views of an interior surface of a door assembly of the work machine.
Figure 3A:
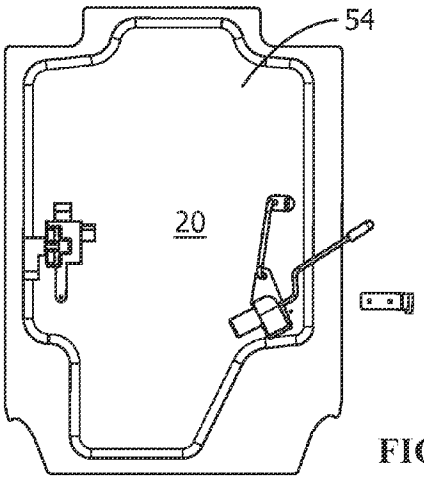

FIG. 1 shows a work vehicle 10 having a lifting structure 12 that includes an arrangement of structural members and actuators controllable by an operator (not shown) to manipulate an implement 14 to perform work. Work vehicle 10 further includes an enclosure or enclosed space, such as a cab structure 15 to surround and protect the operator. As further shown in FIG. 1, cab structure 15 supports a door assembly 16 that is pivotably connected along one side of the door assembly about a pair of hinge assemblies 22 (FIG. 2A) to cab structure 15 to provide operator ingress/egress to work vehicle 10. Door assembly 16 includes a handle and latch to maintain the door assembly in a closed position in a manner that is well known and will not be further discussed herein. FIGS. 2A and 2B show different views of an exterior surface 52 of a substantially transparent door 20 of the door assembly. FIGS. 3A and 3B show different views of an interior surface 54 of substantially transparent door 20 of the door assembly. As further shown in FIGS. 2A and 2B, the door assembly includes a pair of hinge assemblies 22 that are secured to substantially transparent door 20.

For purposes of the disclosure, the terms door and door assembly may be used interchangeably.

Figure 4B:
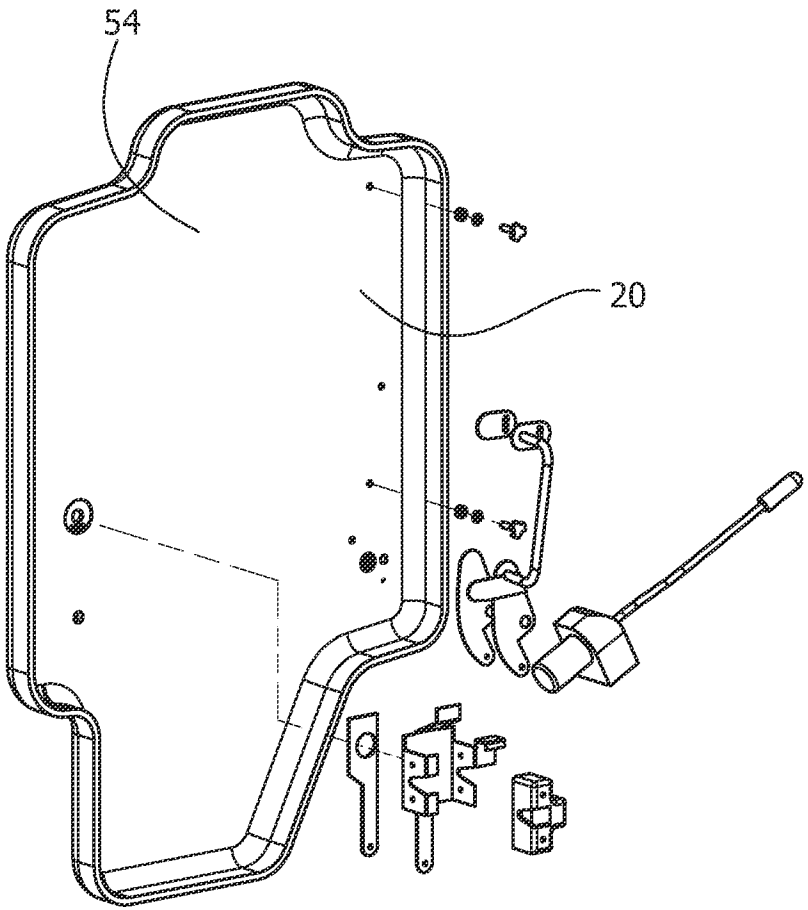
FIG. 4B is an exploded view of the door assembly of FIG. 3B.
Figure 4A:
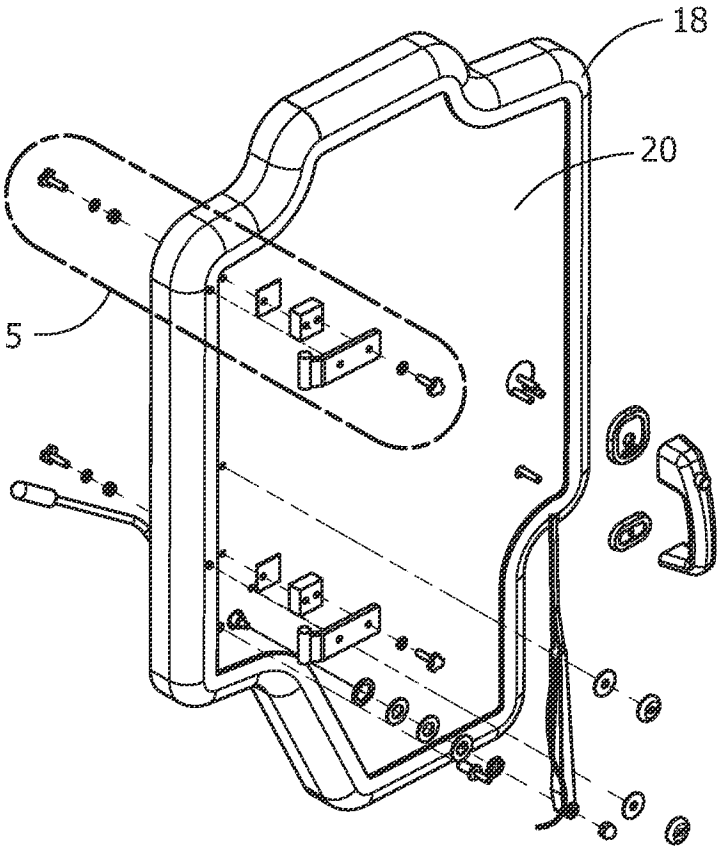
FIG. 4A is an exploded view of the door assembly of FIG. 2B.

FIGS. 4A and 4B show respective exploded views of the door assemblies of FIGS. 2B and 3B. For purposes of clarity, two exemplary embodiments will be discussed based from FIG. 5, which is taken from region 5 of FIG. 4A.

Figure 5:
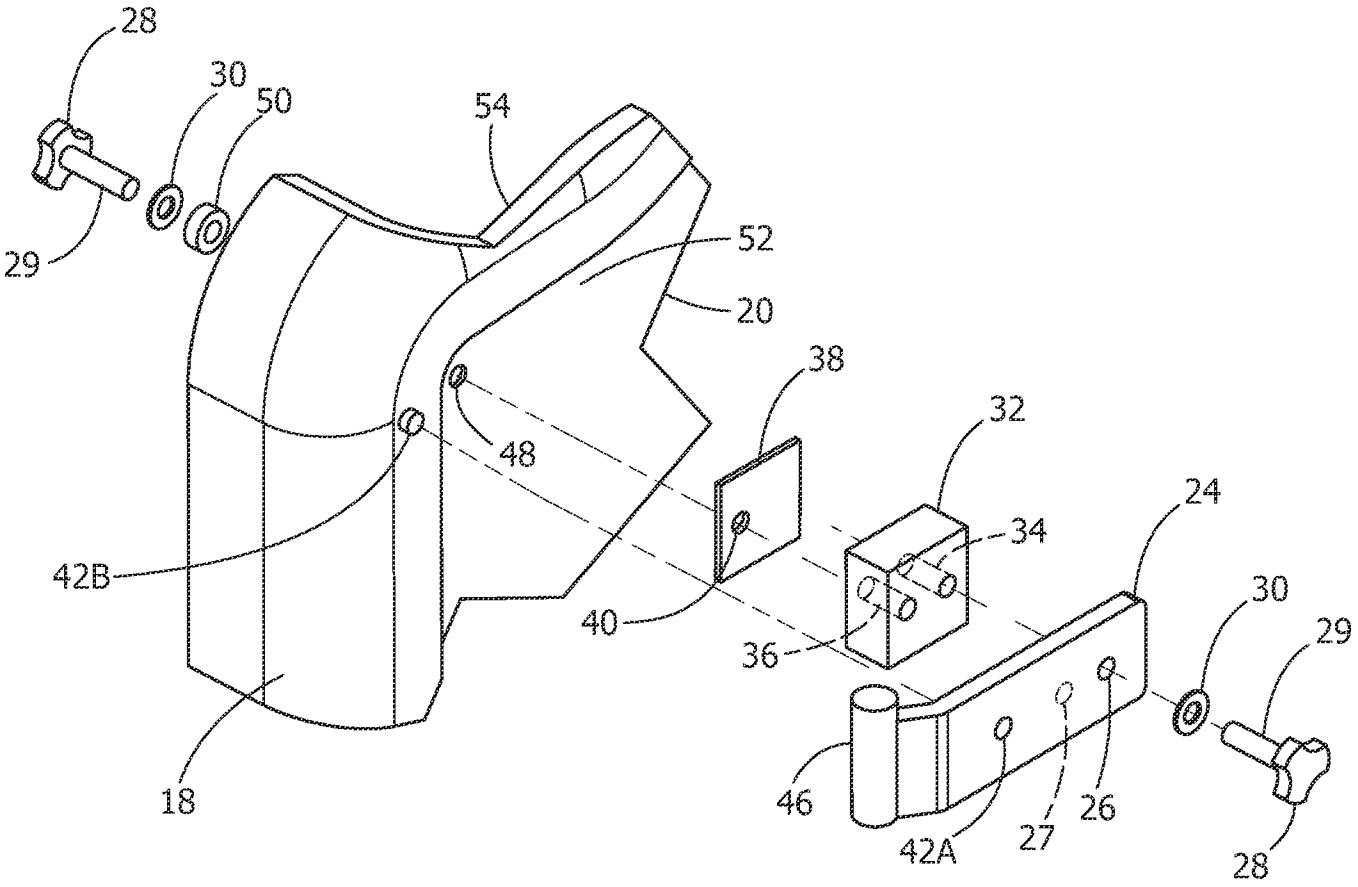
FIG. 5 is an enlarged, partial view of the door assembly of an exemplary embodiment taken along region 5 of FIG. 4A.

In one embodiment, As shown in FIG. 5, which permits an operator to manually remove the door assembly from interior of cab structure 15 (FIG. 1), facing an interior surface 54 of door 20 is securing device 28, such as a thumb screw or threaded fastener with a knurled and/or otherwise easily grasped head for manual installation or removal of the securing device with respect to the door. It is to be understood that the term manual, manually and the like, such as manual installation, manually removeable and the like refers to the ability of an individual to install, remove and the like of the securing device without requiring hand tools. Securing device 28 includes a shank portion or shank 29 that extends through a washer 30 and a resilient spacer 50 that is positioned in an opening 48 formed in substantially transparent door 20. Shank 29 further extends through an aperture 40 formed in a resilient member 38 that abuts exterior surface 52 of door 20 and then is threadedly inserted into a threaded opening 36 formed in receiving member 32. In another embodiment, shank 29 can engage opening 36 such as in the form of a ball-lock or other type of manually actuated engagement therebetween, i.e., without either shank 29 or opening 36 being threaded. Although threaded opening 36 may extend through receiving member 32, shank 29 is sized so as to only partially extend into (and not entirely through) receiving member 32. In a yet further embodiment, shank 29 may extend through receiving member 32 and threadedly engage an aperture 27 formed in a hinge member 24, also commonly referred to as a hinge wing. As will be discussed in further detail below, it is to be understood that with this further embodiment, the door assembly would be manually removable only from interior of cab structure 15.

FIG. 5 shows hinge wing or hinge member 24 that is included as part of hinge assembly 22. One end of hinge wing or hinge member 24 includes a hollow cap 46 that pivotably engages a hinge pin (not shown) forming a hinged connection that is well known and not further discussed herein. As further shown in FIG. 5, hinge member 24 includes a support feature 42A, such as an opening that corresponds with a mating support feature 42B, such as a protrusion configured to receive the opening formed in frame 18 of door assembly 16 (FIG. 1). In another embodiment, support features 42A and 42B may be reversed. The purpose of support features 42A and 42B is to support the weight of the door assembly in response to inadvertent removal of at least one of securing device 28 (i.e., having respective heads positioned interior and/or exterior of the cab structure). That is, in order for the door to be removed or separated from the cab structure subsequent to removal of securing device 28, sufficient force, typically applied in a direction parallel to the protruding portion of support features 42A and 42B, is required.

FIG. 5 shows an embodiment that permits removal of the door from exterior of cab structure 15 (FIG. 1). In this embodiment, securing device 28 having a shank 29, such as previously discussed is inserted through a washer 30 and then through an aperture 26 formed in hinge member 24. Shank 29 further extends and is threadedly engaged with a threaded opening 34 formed in receiving member 32. In another embodiment, shank 29 can engage opening 34 such as in the form of a ball-lock or other type of manually actuated engagement therebetween, i.e., without either shank 29 or opening 34 being threaded. Similar to a previous embodiment, shank 29 is of insufficient length to extend through threaded opening 34 of receiving member 32. Hinge member 24 includes support features 42A and 42B as previously discussed above.

In operation, to remove the door from exterior of the cab structure without actuating the door handle from its latched position, shank 29 of each of the pair of securing devices 28 having respective heads positioned exterior of the cab structure and facing exterior surface 52 of door 20 is sufficiently rotated in a direction to remove the securing device 28 from threaded opening 34, followed by a sufficient force directed at least partially, if not substantially parallel to the direction of a protrusion of support features 42A and 42B, resulting in separation of hinge member 24 from both frame 18 and receiving member 32.

Similarly, to remove the door from interior of the cab structure without actuating the door handle from its latched position, shank 29 of each of the pair of securing devices 28 having respective heads positioned interior of the cab structure and facing interior surface 54 of door 20 is sufficiently rotated in a direction to remove the securing device 28 from threaded opening 36, followed by application of a sufficient force directed at least partially, if not substantially parallel to the direction of a protrusion of support features 42A and 42B, resulting in separation of receiving member 32 from door 20 and separation of support features 42A and 42B between hinge member 24 and frame 18.

It is to be realized that in view of the above, one having ordinary skill in the art would recognize that for an embodiment in which each shank 29 of respective securing devices 28 having respective heads positioned interior of the cab structure, extending through threaded opening 36 and then threadedly engaging apertures 27 of hinge member 24, removal of securing devices 28 having respective heads positioned exterior of the cab structure would not result in removal of the door.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A door escape, comprising:

a door having an interior surface and an opposing exterior surface;

a hinge member secured to the door and pivotally movable about a hinge pin via a hollow cap portion of the hinge member, the hinge member defining an aperture;

a receiving member disposed between the exterior surface of the door and the hinge member, the receiving member having a first threaded opening aligned with the aperture of the hinge member and a second threaded opening formed therein adjacent to the first threaded opening;

a first securing device having a head interconnected to a shank, the shank extending through the aperture of the hinge member and partially into the first opening of the receiving member, the shank being threadably engaged with the first opening, the head being disposed outward from the hinge member; and a second securing device having a head interconnected to a shank, the shank extending through the interior surface and the exterior surface of the door and into the second opening of the receiving member, the shank being threadably engaged with the second opening, wherein the head is disposed outward from the interior surface of the door.

2. The door escape as in claim 1, wherein the first securing device secures the hinge member to the receiving member.

3. The door escape as in claim 1, wherein the second securing device secures the receiving member to the door.

4. The door escape as in claim 1, wherein at least one of the first securing device and the second securing device is a thumb screw or a ball-lock fastener.

5. The door escape as in claim 1, further comprising mating support features formed in corresponding portions of the hinge member and the door.

6. The door escape as in claim 5, wherein the mating support features comprise a protrusion configured to be received by an opening.

7. The door escape as in claim 5, wherein the mating support features are configured to support the weight of the door in response to inadvertent removal of at least one of the first securing device and the second securing device.

8. A door escape, comprising:

a door having an interior surface and an opposing exterior surface;

a hinge member secured to the door and pivotally movable about a hinge pin via a hollow cap portion of the hinge member, the hinge member defining a first aperture and a second aperture;

a receiving member disposed between the exterior surface of the door and the hinge member, the receiving member defining a first threaded opening aligned with the first aperture of the hinge member and a second threaded opening aligned with the second aperture;

a first securing device having a head interconnected to a shank, the shank extending through the first aperture of the hinge member and partially into the first opening of the receiving member, the shank being threadably engaged with the first opening, the head being disposed outward from the hinge member; and a second securing device having a head interconnected to a shank, the shank extending through the interior surface and the exterior surface of the door, through the second opening of the receiving member and into the second aperture of the hinge member, the shank being threadably engaged with the second opening and the second aperture, wherein the head is disposed outward from the interior surface of the door.

9. The door escape as in claim 8, wherein the first securing device secures the hinge member to the receiving member.

10. The door escape as in claim 8, wherein the second securing device secures the receiving member to the door and the hinge member.

11. The door escape as in claim 8, wherein at least one of the first securing device and the second securing device is a thumb screw or a ball-lock fastener.

12. The door escape as in claim 8, further comprising mating support features formed in corresponding portions of the hinge member and the door.

13. The door escape as in claim 11, wherein the mating support features comprise a protrusion configured to be received by an opening.

14. The door escape as in claim 11, wherein the mating support features are configured to support the weight of the door in response to inadvertent removal of the second securing device.

15. A door escape for a work vehicle having a lifting structure interconnected to an implement and a lifting structure interconnected to an implement, the door escape comprising:

and a door having an interior surface and an opposing exterior surface, wherein the interior surface faces the interior of the cab structure;

a hinge member extending along the exterior surface and secured to the door, the hinge member being pivotally movable about a hinge pin via a hollow cap portion of the hinge member, the hinge member defining an aperture;

a receiving member disposed between the exterior surface of the door and the hinge member, the receiving member having a first threaded opening aligned with the aperture of the hinge member and a second threaded opening formed therein adjacent to the first threaded opening;

a first securing device having a head interconnected to a shank, the shank extending through the aperture of the hinge member and partially into the first opening of the receiving member, the shank being threadably engaged with the first opening, the head being disposed outward from the hinge member; and a second securing device having a head interconnected to a shank, the shank extending through the interior surface and the exterior surface of the door into the second opening of the receiving member, the shank being threadably engaged with the second opening, wherein the head is disposed outward from the interior surface of the door.

16. The door escape as in claim 14, wherein the first securing device secures the hinge member to the receiving member.

17. The door escape as in claim 14, wherein the second securing device secures the receiving member to the door.

18. The door escape as in claim 14, wherein at least one of the first securing device and the second securing device is a thumb screw or a ball-lock fastener.

19. The door escape as in claim 14, further comprising mating support features formed in corresponding portions of the hinge member and the door, wherein the mating support features are configured to support the weight of the door in response to inadvertent removal of at least one of the first securing device and the second securing device.

20. The door escape as in claim 14, wherein the hinge member further comprises a second aperture formed therein, and wherein the shank of the second securing device extends through the second threaded opening and through the second aperture.

21. The door escape as in claim 19, wherein the shank of the second securing device is threadably engage with the second aperture.

* * * * *